US009107795B2

(12) United States Patent
Faussett

(10) Patent No.: US 9,107,795 B2
(45) Date of Patent: Aug. 18, 2015

(54) ROLLING MUSCLE MASSAGER

(75) Inventor: Spring S. Faussett, Kent, WA (US)

(73) Assignee: Polar Fusion LLC, Kent, WA (US)

( * ) Notice: Subject to any disclaimer, the term of this patent is extended or adjusted under 35 U.S.C. 154(b) by 0 days.

(21) Appl. No.: 13/597,124

(22) Filed: Aug. 28, 2012

(65) Prior Publication Data

US 2012/0323151 A1 Dec. 20, 2012

Related U.S. Application Data

(63) Continuation of application No. 12/032,290, filed on Feb. 15, 2008, now abandoned.

(60) Provisional application No. 60/890,404, filed on Feb. 16, 2007.

(51) Int. Cl.
*A61H 15/00* (2006.01)

(52) U.S. Cl.
CPC .... *A61H 15/0092* (2013.01); *A61H 2015/0014* (2013.01)

(58) Field of Classification Search
CPC ..... A61H 7/00; A61H 7/002; A61H 7/003; A61H 15/00; A61H 15/0007; A61H 15/0014; A61H 15/0021; A61H 15/0028; A61H 15/0035; A61H 15/0042; A61H 15/005; A61H 15/0057; A61H 15/0064; A61H 15/0071; A61H 15/0092
USPC ..... 601/107, 118–129, 134, 135, 15, 61, 601/63, 64, 112, 115; 482/126, 132
See application file for complete search history.

(56) References Cited

U.S. PATENT DOCUMENTS

| | | | | |
|---|---|---|---|---|
| 718,594 | A | | 1/1903 | Bailey |
| 1,609,544 | A | | 12/1926 | Hamersley et al. |
| 1,811,764 | A | | 6/1931 | Sherwood |
| 2,014,293 | A | | 9/1935 | Riley |
| 2,577,129 | A | | 12/1951 | Johnston et al. |
| 3,664,334 | A | | 5/1972 | O'Neil |
| 3,847,144 | A | | 11/1974 | Wright |
| 4,002,163 | A | | 1/1977 | Jackson, Jr. |
| 4,008,715 | A | | 2/1977 | Brodbeck |
| 4,086,922 | A | | 5/1978 | Henderson |
| 4,345,757 | A | | 8/1982 | Lo Voi |
| 4,416,166 | A | | 11/1983 | Jannard et al. |
| 4,648,387 | A | | 3/1987 | Simmons |
| 4,745,909 | A | | 5/1988 | Pelton et al. |
| 4,884,560 | A | * | 12/1989 | Kuracina ..... 601/19 |
| 4,945,900 | A | | 8/1990 | Masuda |
| 5,131,383 | A | | 7/1992 | Juarez |
| D347,898 | S | | 6/1994 | Belcher |
| D371,202 | S | | 6/1996 | Zajas et al. |
| 5,577,995 | A | | 11/1996 | Walker et al. |
| 5,643,182 | A | * | 7/1997 | Engel ..... 601/119 |

(Continued)

*Primary Examiner* — Rachel Young
(74) *Attorney, Agent, or Firm* — Seed IP Law Group PLLC

(57) ABSTRACT

A portable rolling massager is provided that includes a spindle, a roller rotatably mounted on the spindle, and a covering for the roller that features a comfortable surface when applied to the skin and pressure is applied to muscles underlying the skin. Heating and cooling of the cover provides other therapeutic benefits. Storage in the spindle accommodates weights, flashlights, key storage, music devices, and the like. Hand grips having distal ends are designed to provide the ability to massage trigger points that develop in the muscles.

19 Claims, 4 Drawing Sheets

(56) References Cited

U.S. PATENT DOCUMENTS

| | | | | |
|---|---|---|---|---|
| 5,653,664 | A | 8/1997 | Jennings | |
| 5,709,705 | A | 1/1998 | Belcher | |
| 6,065,210 | A | 5/2000 | Bove | |
| 6,135,972 | A | 10/2000 | Kuo | |
| 6,419,650 | B1 | 7/2002 | Ryan et al. | |
| 6,764,456 | B1 | 7/2004 | Doherty | |
| 7,465,296 | B2 * | 12/2008 | Chau | 604/291 |
| 2003/0090464 | A1 | 5/2003 | Lai et al. | |
| 2005/0096159 | A1 | 5/2005 | Houston et al. | |
| 2006/0142677 | A1 | 6/2006 | Perez | |
| 2007/0129654 | A1 * | 6/2007 | Anderson | 601/119 |

* cited by examiner

ROLLING MUSCLE MASSAGER

BACKGROUND OF THE DISCLOSURE

1. Field of the Disclosure

The present disclosure pertains to devices for massaging one's own muscles or the muscles of another person and, more particularly, to a hand-held portable massage device that makes rolling contact with the human body to offer various levels of self or partner massage.

2. Description of the Related Art

Numerous designs have been proposed for devices that massage the human body, including those having rolling elements that manipulate the muscles underlying the skin. These rolling elements are designed to minimize friction with skin as moving pressure is applied to the subject's body.

One design for a massager utilizing a plurality of rollers is illustrated in U.S. Design Pat. No. 347,898. As shown therein, a handle has a plurality of rotating beads mounted thereon to make contact with the human body for massage. Although this design exhibits the ability to massage the body, the multiple beads are made of hard plastic material that can feel uncomfortably cold to the skin when applied to the body. Additionally, these multiple beads tend to pinch the skin and pull out hair, making it uncomfortable to the subject. Moreover, the narrow diameter of the beads creates discomfort when applied with pressure that is required to massage the muscles. As a result, a desired massage cannot be obtained.

A back massager is described in U.S. Pat. No. 6,065,210 in which roller bearings are mounted to a hollow shaft and have magnets embedded therein. As with the previous device, these roller bearings can pinch the skin, pull hair, and otherwise create discomfort to the subject when forcefully applied to the skin.

BRIEF SUMMARY OF THE DISCLOSURE

The present disclosure is directed to a rolling muscle massager in which, in one embodiment, a spindle having an axle portion is provided with first and second handle portions formed on opposing ends thereof, and a roller is rotatably mounted on the spindle to rotate about the axle portion.

In accordance with another aspect of the disclosure, the spindle is provided with at least one handgrip on one end, and a second handgrip or a cap that retains the roller in position on the spindle and that covers an opening to a hollow interior of the spindle as well as provides access to the hollow interior of the spindle.

In accordance with another aspect of the disclosure, first and second handgrips are formed on the first and second handle portions. Ideally a retaining member is positioned between the roller and the first and second handgrips to retain the roller on the axle portion of the spindle.

In accordance with another aspect of the present disclosure, a cushioning material is provided on an exterior surface of the roller to provide comfort to the user when applied to the skin.

In accordance with another aspect of the present disclosure, first and second handgrips are mounted on the first and second ends of the spindle, each handgrip including a flange on one end to retain the roller over the axle portion of the spindle.

In accordance with another embodiment of the present disclosure, a lightweight, portable multipurpose rolling massager device for use by hand or on a supporting surface is provided that includes: an elongated plastic (or other material such as metal, wood, etc.) support member having opposing distal ends and a bearing surface; a massage member rotatably mounted on the elongated support member to rotate about the support member, the massage member comprising a plastic bearing that has an internal surface adapted to bear against the bearing surface of the support member; and at least one handgrip, each at least one handgrip having a longitudinal axial bore sized and shaped to be slidably received over the distal end of the support member and formed of pliable material to facilitate gripping, each handgrip having a proximal flange sized to support the massage member above the supporting surface and a distal flange that defines a substantially flat end face, the distal flange and end face formed to be bendable to facilitate massage with the end face and flange.

In accordance with another aspect of this embodiment, the massage member is formed of a hollow plastic roller having the plastic bearing formed on an interior of the roller, the massage member further comprising a compliant massage surface formed on the roller. In another aspect, the massage surface is formed of a hollow, stretchable, tubular sleeve having a cylindrical shape that stretches at least in diameter to expand and be slidably receivable over the roller and to contract and grip the roller to retain the sleeve in position on the roller.

In accordance with another aspect, the at least one handgrip can be slidably removed from the support member to provide access to a compartment formed inside the support member.

In accordance with another aspect of the foregoing embodiment, each at least one handgrip includes a compartment formed in the longitudinal axial bore of the handgrip that provides flexibility and enhances the ability to bend the distal end of the handgrip. Ideally the compartment is filled with at least one from among air, liquid, compressible dry material, and material that forms the handgrip.

As will be readily appreciated from the foregoing, the cushioned roller has a surface that is comfortable to the skin when pressure is applied and the muscles are massaged. The device is suitable for hand-held use by an individual for self-massage or for massaging a partner.

BRIEF DESCRIPTION OF THE SEVERAL VIEWS OF THE DRAWING(S)

The foregoing and other features and advantages of the present disclosure will be more readily appreciated as the same become better understood from the following detailed description when taken in conjunction with the accompanying drawings, wherein.

DETAILED DESCRIPTION OF THE DISCLOSURE

Figure 1:
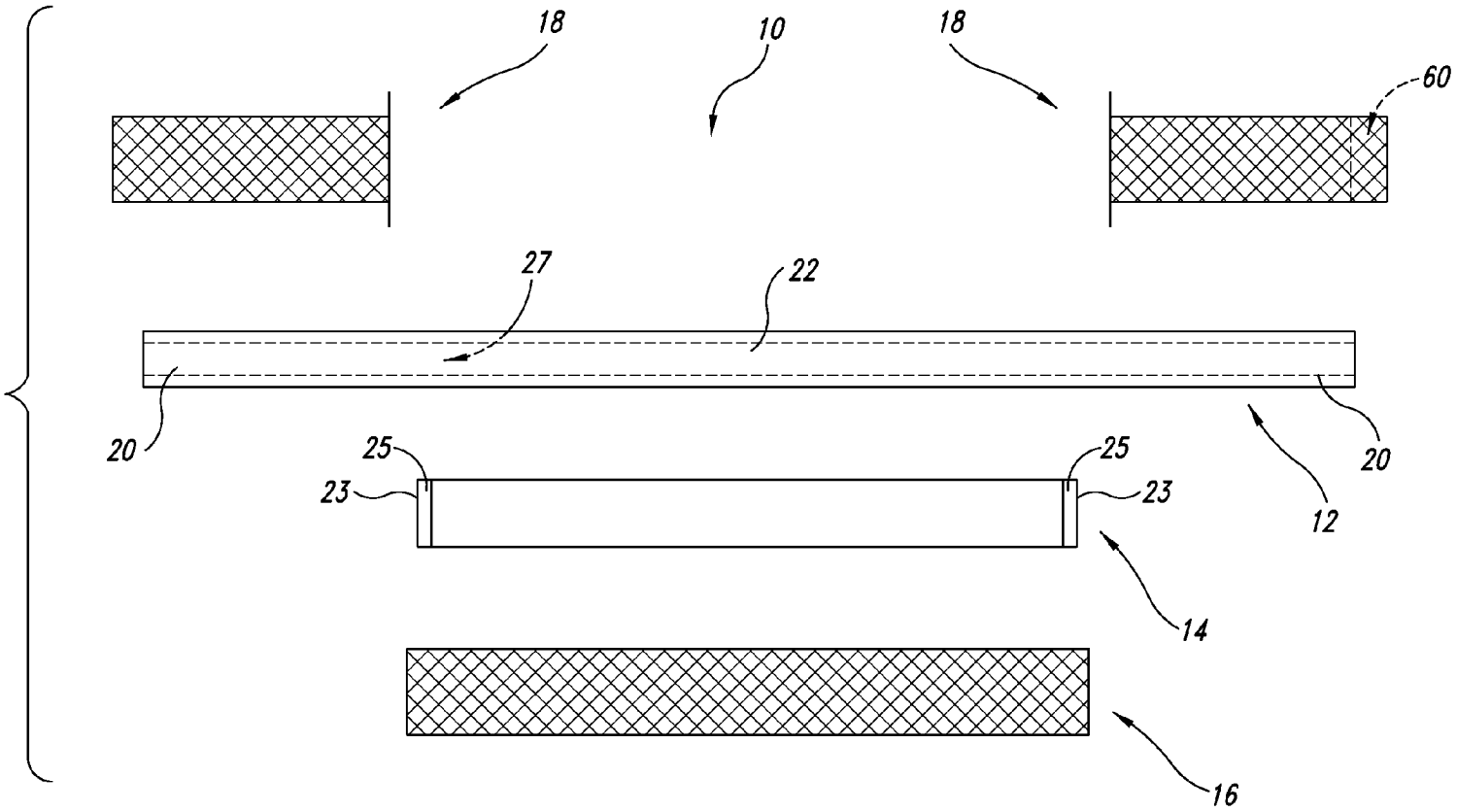
FIG. 1 is an exploded view of the components of a rolling muscle massager formed in accordance with the present disclosure.
Figure 2:
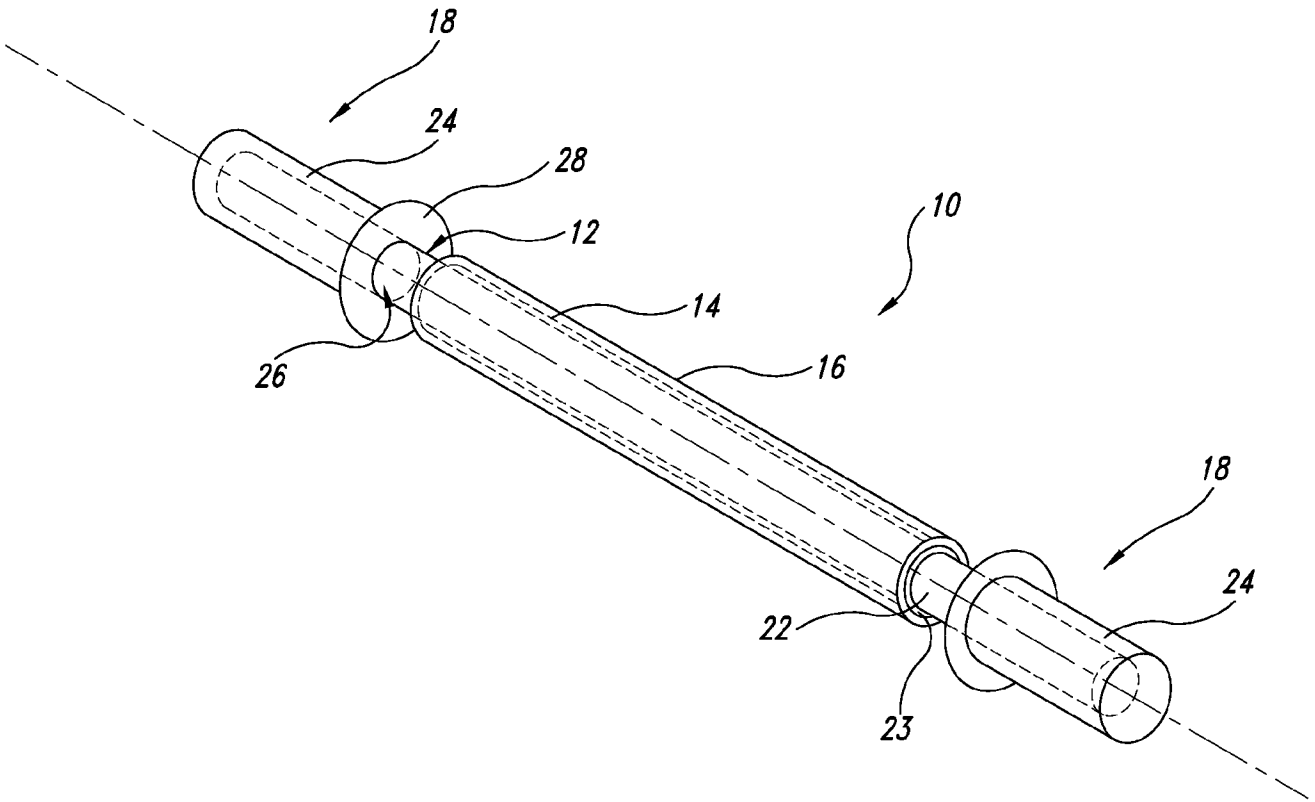
FIG. 2 is a partial assembly of the rolling muscle massager formed in accordance with the present disclosure.

Referring to FIGS. 1 through 2, shown therein is a rolling muscle massager 10 having a spindle 12 and a roller 14 configured to be mounted over the spindle 12 for rotatable engagement thereon. A cover 16 is adapted for mounting over the roller 14, and pair of handgrips 18 is slidably engagable with the ends 20 of the spindle 12, the ends 20 forming handle positions for the massager 10.

More particularly, the spindle 12 is an elongated rigid, tubular or cylindrical member that is either solid or has a hollow core. It has a length in the range of 8 inches to 30 inches.

In a representative embodiment, the spindle 12 can be formed from plastic material, including without limitation standard schedule 40 one-half inch PVC pipe, such as electrical conduit or water pipes that are readily available at most commercial stores. These pipes provide the most inexpensive material on the market to be used for this purpose. However, it is to be understood that other materials may be used, such as wood, metal, and other composites, although the PVC pipe is preferred due to availability, cost, weight, and ability to provide an appropriate bearing surface. Certain glass and magnetized materials can also be used as desired.

Typically, the spindle 12 has an average outside diameter of approximately 21.29 mm (on average, this varies based on the manufacturing process), having a preferred range of 21-22 mm, and a full range of 6.35 mm to 38.11 mm. In the event the spindle 12 is hollow, the inside diameter has an average dimension of 15.39 mm (although the average varies due to imprecision in the manufacturing process), and ranges from 15-16 mm. The average wall thickness of the spindle 12 is approximately 3.04 mm and typically ranges from 3.0-4.0 mm (can be 2.90).

The roller 14 can be formed of the same materials as the spindle 12. In a preferred embodiment, the roller is standard schedule 20 three-quarter inch PVC pipe having an average inside diameter of 23.38 mm, with a preferable range of 23.0-24.0 mm (which can dip to 22.80). However, the inside diameter can range from 8.14 mm to 40.50 mm. The average outside diameter is approximately 26.6 mm (again this varies due to variations in the manufacturing process) and preferably ranges from 26.0-27.0 mm, although the range can be from 9.8 mm to 42.16 mm. The wall thickness averages 1.66 mm and ranges from 1.0-2.0 mm. The length is in the range of 4 inches to 30 inches and preferably in the range of 8 inches to 16 inches.

When the roller 14 is mounted on the spindle 12, the clearance between these two elements is approximately 2.0 mm with a tolerance of +/−0.50 mm at an optimum. However, the clearance can range from 1.0-4.0 mm and even greater, but performance will be degraded with greater clearances. The spindle 12 has an axle portion or bearing surface 22 that is, in one embodiment, unfinished and has the same surface as the ends 20. In other embodiments, the axle portion 22 can be polished to reduce friction between the roller 14 and the spindle 12.

Ideally, a lubricant is provided to reduce friction in the areas where the roller 14 contacts the spindle 12. Preferably petroleum grease or "jelly" is used as the lubricant. This architecture avoids the need for roller bearings and other complicated and expensive bearing structures. In one embodiment, the a beveled 25 of the roller 14 is tapered away from the end face 23 to present a flat surface that has less of a surface to bear against the handgrip 18, thus reducing friction. Friction is also reduced through the use of the lubricant between the bearing surfaces of the roller 14 and the spindle surface 22.

As an improvement over prior devices, the roller 14 is of one piece, avoiding the pinching of the skin and pulling of the hair that plagues prior designs. Instead of hard cold plastic or metal, the present design utilizes a soft foam surface covering 16 over the roller 14 so that it warms quickly to the touch. This cover 16 makes it more comfortable and increases the surface area to help distribute pressure over the muscles to give a preferred massage. The cover 16 may be either a non-permanent or permanent surface for the roller 14 and may be made from foam, rubber, fabric, or other composite.

In one embodiment, the cover is of a cylindrical tubular shape having a hollow core with an inside diameter of approximately 26.97 mm with a range of 26-27.5 mm. The thickness is on average 3.19 mm (this varies due to the manufacturing process) although the range could be from 1-250 mm. While there can be no clearance between the inside diameter of the cover 16 and the outside diameter of the roller 14 so that the cover 16 is retained in place on the roller 14 via friction, an approximate 0.50 mm clearance can be provided to allow for ease of assembly. Ideally, the cover 16 is formed of a pliable, compliant, flexible material that stretches in diameter and returns to its original shape. This enables the cover to be slid over the outside surface of the roller 14 and stay in place due to the compression of the cover on the roller.

In one embodiment the cover 16 is formed of a sponge-like material that can retain a small portion of water or other liquid that is then squeezed out on to the skin of a user when the massager 10 is rolled over the user's skin. The liquid can be warm or cold, as desired.

Adhesive or other means of attachment of the cover 16 to the roller 14 can be provided that do not interfere with the comfort of the cover 16. In addition, the cover 16 can be formed of a coating of material that is applied in a liquid or other state to the roller 14 and then allowed to cure. When the roller 14 is made of ¾ inch PVC pipe, the optimal cover 16 will have an average 26.96 mm inside diameter (which can vary due to manufacturing process variations), although the size can range from 23.89 mm to 30.49 mm.

Handgrips 18 can be provided on the ends 20 of the spindle 12, or the spindle 12 can have integral handgrips formed on the respective ends 20. In the embodiments shown in FIGS. 2 and 3, the handgrips 18, 19 are separate elements and include a cylindrical body 24 (shown in FIG. 2) having a hollow interior 26 sized and shaped to be received over the spindle ends 20. In one embodiment the handgrips are a stretchable plastic and have an optimal inside diameter of approximately 0.875 mm that fit over the one-half inch PVC pipe of the spindle 12. Depending on the tolerances of the PVC pipe, the handgrips 18, 19 can have an inside diameter ranging from 0.3 inches (7.62 mm) to 1.42 inches (36.068 mm). They are retained on the spindle 12 by friction, although adhesive can be used to permanently adhere the handles 18, 19 to the spindle 12.

A flange 28 is formed on one end, preferably a proximal end, of the handgrips 18, 19 having a sufficient height to act as a retainer and a bearing surface for the roller 14 to retain the roller 14 over the axle portion 22 of the spindle 12. An optional washer (not shown) can also be used between the handgrips 18, 19 and the roller 14 to help reduce friction and to act as a flange. In addition, the flange 28 is of sufficient height to support the roller 14 above the ground when the rolling muscle massager 10 is placed on the ground in a horizontal orientation.

On one or both of the grips 19 (shown in FIG. 3) can be formed with a ridge or flange 40 that enables a user to place the massager on a surface, such as the ground, while preventing the center spindle from making contact with the ground so that the massager can freely roll while on the surface. In other words, a user can maintain the spindle in a stationary position while moving a limb across the roller so that the roller 14 rotates about the spindle 12. This ridge 40 can be removably attached to the spindle, such as to one or both of the handgrips 19 or, more preferably, integrally formed therewith.

Alternatively, in accordance with another aspect of the foregoing embodiment, each handgrip 19 can be formed to have an internal compartment 60 or area at a distal end of the longitudinal axial bore of the handgrip to provide flexibility and enhance the ability to bend the distal end of the handgrip 19. Ideally the compartment is filled or the area is formed with at least one from among air, liquid, compressible dry material, and material that forms the handgrip.

Ideally the cover 16 is formed of a non-absorbent surface, such as closed cell foam, for easy washing and disinfecting. A non-optimal surface would be one that is absorbent, such as open cell foam. In accordance with another embodiment, the cover 16 and handgrips 18 can be impregnated with antibacterial chemicals to reduce the risk of infection. The cover 16 and the handgrips 18 can, for example, be formed to have an antibacterial substance that is released when gripped by a human hand. In accordance with another embodiment, the cover 16 can be formed of sponge-like material that holds an amount of liquid (hot, warm, cool, or cold) that is squeezed out during application of the rolling massage device to the user's skin.

Other features and advantages of the present design can include molded surfaces on the cover 16 to aid with massage. These surfaces can be bumps, nubs, recesses, ridges, and the like. In addition, the roller 14 can be formed of multiple segments under the foam cover 16 and the spindle 12 can be formed of bendable material such that the massager 10 has a certain amount of flexibility to provide a more conforming massage.

In accordance with another embodiment of the disclosure, the core 12 or the roller 14 can be equipped with a heater or a cooler to provide heated or cold massage, respectively. This heating and cooling ability can be a characteristic of the foam cover 16 itself or heat can be applied from a heater or withdrawn by a heat sink via various devices commercially available that are mounted inside a hollow portion of the spindle 12 or formed as part of the roller 14.

In accordance with another embodiment, the spindle 12 can be hollow with covers on both ends or a handgrip on one end and a cover on another end that secure access to the hollow core 27, thus providing storage for flashlights, weights, music devices, reading material, and the like. Resilient plugs, removable caps, and hinged covers can all be used to secure access to the interior of the spindle 12.

As will be readily appreciated from the foregoing, the device of the present disclosure is intended to be a portable massager that allows various levels of self or partner massage applied directly to the skin or over one or more layers of clothes. It may be applied while sitting or standing in any type of location, on any part of the body such as feet, legs, torso, back, arms, neck and head that may be reached individually or with a partner.

The design of the present disclosure includes a handle either non-permanently or permanently affixed to a center core formed of a material such as metal, plastic, or wood. The roller is formed of material such as metal, plastic, or wood that slides over the spindle and proceeds to roll freely thereon. A cover on the roller provides a non-permanent or permanent surface that is comfortable to the human body without pinching of the skin or pulling of the hair.

Figure 4:
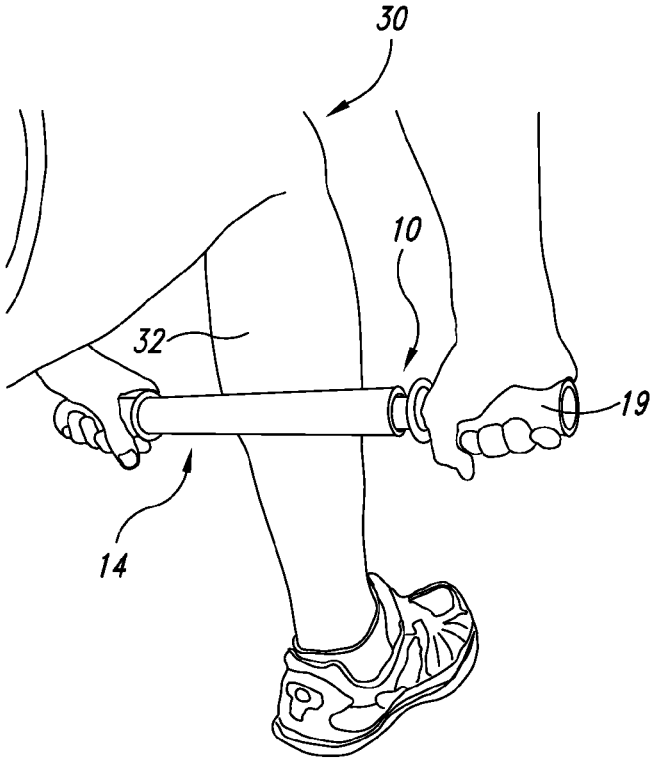
FIG. 4 is an isometric view of the massager of FIG. 3 in use.

FIG. 4 is one example of muscle massage by an individual using the device 10 of the present disclosure. As shown therein, an individual user 30 grasps the handgrips 19 and places the roller 14 against their calf 32. The massager 10 is then rolled vertically along the calf 32. Because of its versatility, the massager 10 can be manipulated for rolling in different directions and across various muscles of the body, including without limitation the neck, shoulders, arms, upper back, lower back, buttocks, thighs, hamstrings, quads, shins, and feet. When properly used, the rolling muscle massager 10 helps relieve sore, tight, cramping, fatigued and stiff muscles by helping restore muscular balance.

The massager 10 provides an easy to use, natural pain relief and healing aid; controlled muscle manipulation that smoothes, loosens, relaxes and soothes; and it assists individuals in performing solo deep tissue massage, solo trigger point therapy and solo sports massage therapy.

It is recommended and used by athletes, sports trainers, massage physical therapists, physicians, and chiropractors. The innovative massage foam instantly adjusts to skin temperature, and the high density, shock absorbing, durable massage foam won't deteriorate like most foam.

Ergonomically designed, non slip grips increase comfort, reduce hand fatigue and facilitate greater massage pressure. The independently rolling massage bar glides smoothly over bare skin/clothing. It is portable and easy to pack for travel, and the design facilitates easy cleaning and washing.

The directions for use are set forth below:

It typically takes 10-20 rolls over the muscle to warm up healthy muscle tissue. This equates to working each muscle area for about 10-20 seconds. To be most effective, it works best to progressively press harder on the muscle area with each roll.

Massage therapists refer to tender bumps or knots in the muscle as "trigger points." Trigger points are described by professionals as a small contraction knot in muscle tissue and are a common cause of pain. Trigger points can vary in depth under the skin and can be the size of a small pea, a piece of macaroni—or even larger like a small pickle. They also cause a person to feel a tremendous amount of pain when pressed upon.

Trigger points affect muscles by keeping them in a constant state of contraction, keeping the muscles very tense in a very small targeted area. This constant tension restricts circulation in its immediate area, causing pain at its source, or often causing "referred" pain, which means the pain is felt in an area that does not appear to be related to the source. For example, pain in the knee can be referred pain from a trigger point in the quadriceps.

Do-it-yourself trigger point therapy is self-applied massage directed specifically at trigger points. With the proper technique and tools (such as using the rolling muscle massager disclosed herein), a person can offer themselves significant trigger point pain relief. Depending on the severity of the problem, significant relief of symptoms can be obtained in just a few minutes. Most are resolved in three to ten days. Long-standing, chronic conditions may take six weeks or longer to resolve.

Do-it-yourself trigger point therapy works in three ways: it releases the muscle memory (a chemical and neurological feedback loop that maintains muscle contraction); releases the restriction of blood flow caused by the contraction and therefore increases circulation; and helps stretch the muscle fibers.

Do-it-yourself massage also offers several benefits: You do not have to wait or make an appointment with a therapist; you can help yourself whenever you need it; and you do not have to pay for it. Using the rolling muscle massager for do-it-yourself massage offers all of these benefits, plus you prevent injury to your own forearms, hands, and fingers.

When the rolling massager passes over a "trigger point" discomfort or pain may be experienced; however, most people find this to be a good pain—especially when the rolling massager assists the muscle in releasing the "cramp."

Chronic trigger points often need additional attention. The user must slowly and gradually work the massager deeper into the muscle to work out the trigger point. Using the muscle massager several times daily may be necessary. Over the course of time, trigger points should lessen in severity.

Figure 3:
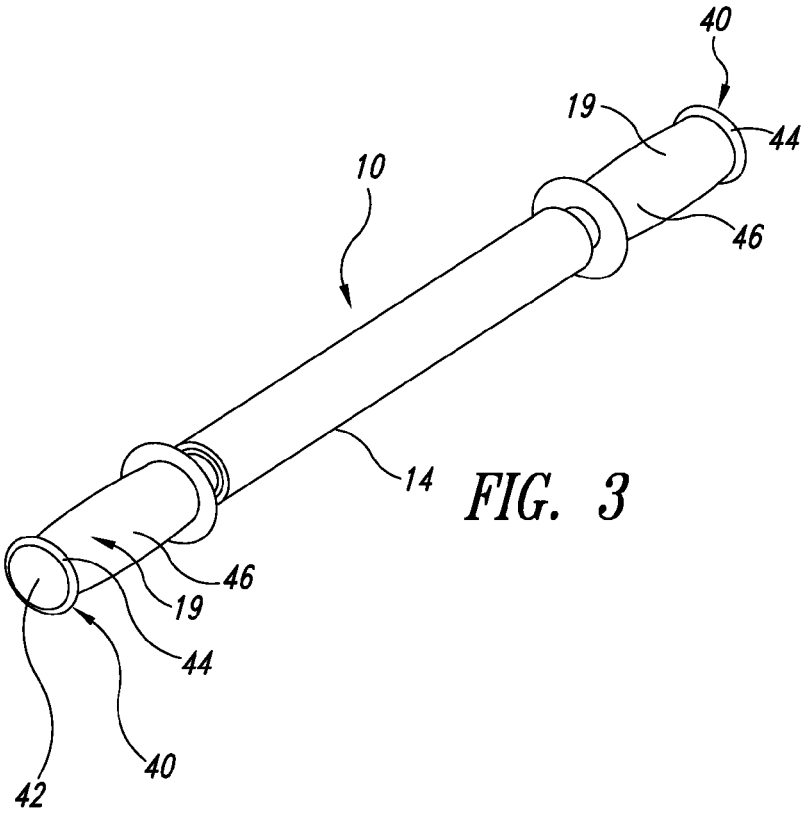
FIG. 3 is an isometric view of the assembled massager of FIG. 2.

The handles 19 are formed to aid in this type of massage. As shown in FIG. 3, the handles have the enlarged distal end flange 40 having a flat end face 42 with an enlarged, pliable or flexible annular ring portion 44 with a diameter that exceeds a diameter of the grip portion 46. It is to be understood that the flange 40 can have a shape other than a circular shape, such as square, octagonal, or other polygonal shape. The flat surface of the end face 42 is preferred because a convex or bulbed end face 42 would tend to dig into the muscle tissue, causing discomfort and possible injury. This end face 42 can be depressed inward due to the nature of the material and the construction of the handle, as set forth in more detail herein below. This depressibility of the end face 42 aids in therapeutic use of the roller 10. It is to be understood that the handle 19 can be formed without the flange portion 40, as in handle 18. However, the end face 42 in combination with the bendable annular ring portion 44 allows a user to manipulate the roller 10 in a way that takes advantage of the flexing of the annular ring portion 44.

In another embodiment, the handle 19 has the distal end formed with a compressible compartment 60 filled with compressible material, such as an air pocket or pliable material to enable bending of the distal end, including the annular ring portion 44 and the end face 42 during massage. This can be accomplished by having a shoulder or ridge formed in the bore 26 that stops movement of the handle 19 on to the spindle 22 or in the alternative a shoulder or ridge can be formed on the spindle 22 that stops the handle 19 from sliding all the way on to the spindle 22, thus leaving an internal air gap between the distal end of the spindle 22 and the distal end of the handle 19.

The user may use the handles as a trigger point tool by pressing the end of the handle directly into the center of the trigger point and applying direct pressure for approximately 10 seconds. To use the handles for massage, the user may apply the handle by situating and applying the handles perpendicularly in relationship to the user's body part, such as on a limb or torso. The user is advised to repeat such pressure two additional times, 10 seconds each. In between the 10 second set, it is recommended the user alternate massage with the roller of the rolling massager. The end of the handle mimics the pressure and feeling that is achieved by applying pressure with a thumb or elbow. However, by using the handles the user may prevent possible injury to their thumb, fingers, hands and other limbs.

Alternative Embodiment

Figure 5:
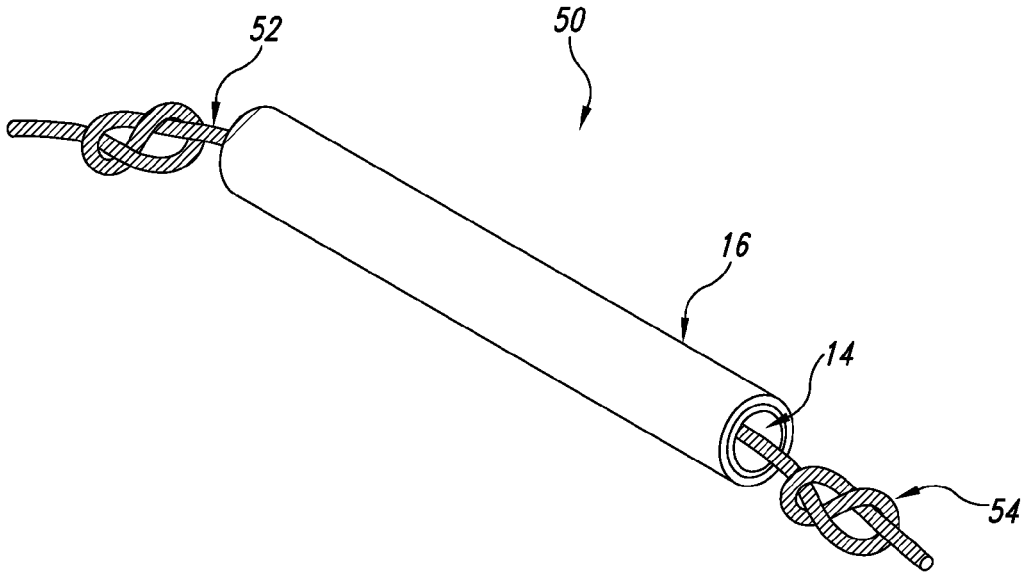
FIG. 5 is an isometric illustration of an alternative embodiment of a massager formed in accordance with the present disclosure.

An alternative embodiment to the present disclosure is shown in FIG. 5 in the form of a rolling muscle massager 50 having the roller 14 mounted over a flexible filament 52 for rotatable engagement thereon. A cover 16 is mounted over the roller, which is preferably constructed in accordance with the description set forth above regarding the previous embodiment. The roller 14 is retained on the flexible filament by knots 54 tied into the flexible filament 52. These knots 52 can facilitate gripping by a user. Knots can also be sewn into the flexible filament or the end can be doubled over and attached to itself in a known manner.

The roller 14 is an elongated tubular or cylindrical member that is either solid or has a hollow core. It has a preferred length in the range of 4 inches to 12 inches. The roller 14 has an average outside diameter of approximately 21.29 mm (which can vary due to variations in the manufacturing process), ranging from 20-21 mm. In the event the roller 14 is hollow, the inside diameter has an average dimension of 15.39 mm (again which can vary based on manufacturing process), and ranges from 15-16 mm. The length of this embodiment can be in the range of 4 inches to 18 inches, and more preferably in the range of 4 inches and 12 inches.

In this alternative embodiment, the roller 14 can be formed from standard schedule 40½ inch (inside diameter) PVC pipe, such as electrical conduit or water pipes that are readily available at most commercial stores. These pipes provide the most inexpensive material on the market to be used for this purpose. However, it is to be understood that other materials may be used, such as wood, metal, and other composites. Certain glass and magnetized materials can also be used as desired. The average thickness of the PVC pipe is approximately 3.04 mm (which can dip lower to 2.90 and can vary based on manufacturing process variations) and ranges from 3.0-4.0 mm.

The roller 14 can also range in size and be made from standard schedule 20 three-quarter inch PVC pipe having an average inside diameter of 23.38 mm (dependent on the manufacturing process), and ranging from 23.0-24.0 mm. The average outside diameter is approximately 26.6 mm and ranges from 26.0-27.0 mm. The thickness averages 1.66 mm (all dimensions can vary based on variations in the manufacturing process) and ranges from 1.0-2.0 mm.

As an improvement over prior devices, the roller 14 is of one piece, avoiding the pinching of the skin and pulling of the hair that plagues prior designs. Instead of hard cold plastic or metal, the present design utilizes a soft foam surface cover 16 over the roller 14 so that it is not cold to the touch. This cover 16 makes it more comfortable and increases the surface area to help distribute pressure over the muscles to give a preferred massage. The cover 16 may be either a non-permanent or permanent surface for the roller 14 and may be made from foam, rubber, or fabric.

There should be no clearance between the inside diameter of the cover 16 and the outside diameter of the roller 14 so that the cover 16 is retained in place on the roller 14 via friction. However a clearance of approximately 0.50 mm can exist to assist with assembly and manufacturing. Adhesive or other means of attachment can be provided that do not interfere with the comfort of the cover 16. In addition, the cover 16 can be formed of a coating of material that is applied in a liquid or other state to the roller 14 and then allowed to cure. When the roller 14 is made of ¾ inch PVC pipe, the cover 16 has a 1.062 inch diameter. When the roller 14 is made of ½ inch PVC pipe, the cover 16 has an approximate 0.84 inch diameter.

The flexible filament 52 is preferably in the form of a rope, ideally of ⅜ inch diameter or above but no larger than the inside diameter of the roller 14. Other forms of flexible filaments can be used, including without limitation nylon braided rope and nylon webbing. Cotton rope has been found to provide too much friction. Handles can be provided on the ends of the flexible filament. In one alternative embodiment the handles are sewn into the flexible filament. In another alternative embodiment the handles can consist of knots 54 made in the flexible filament 52 as described above.

When the roller 14 is placed on a surface, such as the ground, the roller 14 can freely roll while on the surface. In other words, a user can move a limb across the roller 14 so that the roller 14 rotates about the flexible filament.

Ideally the cover 16 is formed of a non-absorbent surface, such as closed cell foam, for easy washing and disinfecting. A non-optimal surface would be one that is absorbent, such as open cell foam. In accordance with another embodiment, the handles can include built-in antibacterial properties. In other words, the handles are formed to have an antibacterial substance that is on the surface or below the surface of the handle and is released to the surface when gripped by a human hand.

Other features and advantages of the alternative embodiment can include molded surfaces on the cover 16 to aid with massage. These surfaces can be bumps, nubs, recesses, ridges, and the like. In addition, the roller 14 can be formed of multiple segments under the foam cover 16.

In accordance with another embodiment of the disclosure, the roller 14 can be equipped with a heater or a cooler to provide heated or cold massage, respectively. This heating and cooling ability can be a characteristic of the foam cover 16 itself or heat can be applied or sunk via various devices commercially available that are formed as part of the roller.

Before beginning any type of therapy or treatment, users should seek the advice of a physician.

All of the above U.S. patents, U.S. patent application publications, U.S. patent applications, foreign patents, foreign patent applications and non-patent publications referred to in this specification and/or listed in the Application Data Sheet, are incorporated herein by reference, in their entirety.

From the foregoing it will be appreciated that, although specific embodiments of the disclosure have been described herein for purposes of illustration, various modifications may be made without deviating from the spirit and scope of the disclosure. For example, a ridge can be formed on the interior surface of the roller 14 that is concentric with the roller surface to act as a bearing that reduces friction between the roller 14 and the spindle. Also, rollers can be interchanged by removing one handgrip and rollers with different features, such as a thicker cover, can be used. Alternatively or in addition, the covers can be interchangeable to accommodate different needs. Accordingly, the disclosure is not limited except as by the appended claims.

The invention claimed is:

1. A massage device for use by hand or on a supporting surface, comprising:

a rigid hollow spindle having an axle portion and first and second handle portions at opposite ends of the axle portion, the spindle having an outer surface, the outer surface having an outer diameter;

a roller having an outer surface and an inner surface, the roller having an outer diameter and an inner diameter, the inner diameter is larger than the outer diameter of the spindle by a first distance to provide a clearance between the roller and the spindle, the roller being positioned on the spindle, the inner surface configured to interact with the outer surface of the spindle, the roller including:

a lubricant configured to separate the inner surface of the roller from the outer surface of the spindle, the lubricant configured to allow the roller to fluidly and quietly rotate about the axle portion of the spindle;

a foam gripping cover frictionally attached to the outer surface of the roller, the gripping cover configured to grip the outer surface of the roller to maintain a fixed position with respect to the roller, the roller and the gripping cover configured to rotate together around the axle portion; and first and second handgrips attached to the first and second handle portions of the spindle by friction to prevent rotation of the handgrips around the handle portions, each handgrip having a flange positioned adjacent to the roller and separated from the roller by a second distance that is larger than the first distance, the flanges having an outer diameter larger than an outer diameter of the gripping cover to allow the flanges to elevate the gripping cover above the supporting surface when in a resting position and during use, the roller being capable of direct contact with each flange of the first and the second handgrips.

2. The device of claim 1, wherein the first and second handgrips each have a ridge positioned at an opposite end of each handgrip relative to the flange, each ridge having a third diameter that is greater than the outer diameter of the roller, the ridge having a flat end face.

3. The device of claim 2, wherein the roller includes first and second end surfaces, each surface having a flat portion and a beveled portion that slopes away from the flat portion, the flat portion configured to bear against the flange of the first and second handgrips.

4. The device of claim 2, further comprising a compressible compartment formed in one of the handgrips.

5. The device of claim 1, further comprising a compartment formed in the spindle that is accessible by removing one of the handgrips.

6. The device of claim 1 wherein the gripping cover includes at least one protrusion that is configured to aid in massaging.

7. A lightweight, portable multipurpose rolling massager device for use by hand or on a supporting surface to relieve tension from a trigger point in a user's muscle, comprising:

an elongate, rigid, hollow support member having a first end opposite to a second end, the support member having an exterior surface, the support member having a first dimension in a first direction;

a single hollow bearing member having a second dimension in the first direction that is less than the first dimension, the support member being positioned within the hollow bearing member, a lubricant configured to separate an interior surface of the bearing member from the exterior surface of the support member, the lubricant configured to reduce friction between the bearing member and the support member to allow the bearing member to roll around the support member and to move along the support member in the first direction;

a thin gripping cover positioned on the bearing member and configured to move with the bearing member as the bearing member rolls around the support member, the gripping cover configured to grip the user's muscle to relieve the tension from the trigger point; and a first handgrip positioned on the first end of the support member and a second handgrip positioned on the second end of the support member, an interior surface of each handgrip being in direct contact with the support member to prevent the handgrips from rotating around the support member, each handgrip having:

a flange positioned adjacent to the bearing member, the flange configured to prevent the user's skin from being pinched as the bearing member rolls along the user's skin, the flange configured to support the device above the supporting surface, the flange of the first handgrip and the flange of the second hand grip separated by a third dimension in the first direction that is greater than the second dimension of the bearing member, the bearing member configured to move along the support member in the first direction between the first and second handgrips, the flanges having a diameter that is greater than an outer diameter of the gripping cover, the bearing member being capable of directly contacting the first and the second handgrips.

8. The device of claim 7, wherein the bearing member is a plastic roller having a plastic bearing formed on the interior surface of the bearing member.

9. The device of claim 7, wherein the gripping cover is a hollow, tubular sleeve having a cylindrical shape that is configured to be slidably receivable over the bearing member and to contract and grip the bearing member to retain the sleeve in position on the bearing member.

10. The device of claim 7, wherein the first handgrip and the second handgrip are slidably removable from the support member to provide access to a compartment formed inside the support member.

11. The device of claim 7, wherein the first handgrip and the second handgrip each include a compartment formed in a longitudinal axial bore of the handgrip.

12. The device of claim 7 wherein the bearing member is configured to shift with respect to the support member in the first direction and in a second direction that is transverse to the first direction.

13. The device of claim 12 wherein a combination of the bearing member and the gripping cover has a fourth dimension in the second direction transverse to the first direction and the flanges have a fifth dimension in the second direction that is greater than the fourth dimension to allow the combination to rotate around the support member while the flanges of the first and second handgrips are positioned on the supporting surface.

14. The device of claim 7 wherein the gripping cover has a smooth exterior surface.

15. The device of claim 7 wherein the gripping cover has a textured exterior surface that includes raised portions and lower portions.

16. A device, comprising: a hollow support member; a first handle and a second handle fixed at opposite ends of the support member and configured to prevent the handles from rotating around the support member, each handle including:

a single, unitary body that includes a grip portion, an end portion, and a flange portion that is separated from the end portion by the grip portion;

a roller member, the roller member positioned on the support member between the first handle and the second handle, the roller member including:

a rigid interior member being configured to rotate around the support member and along the support member between the first handle and the second handle such that the rigid interior member is capable of direct contact with each handle, an interior surface of the interior member being separated from an exterior surface of the support member by a lubricant during use;

a gripping exterior member positioned on the rigid interior member and configured to interact with a user's muscles, an outer diameter of the gripping exterior member being smaller than an outer diameter of each of the flange portions to allow the device to be used in a first configuration in which the user can apply downward pressure to the user's muscles by pressing on the handles to press the gripping exterior member into the user's muscles and a second configuration in which the flange portions of the first handle and the second handle are configured to support the device on a support surface and allow the user to apply downward pressure with the muscle onto the gripping exterior member.

17. The device of claim 16 wherein each of the end portions have a diameter that is less than the outer diameter of each of the flange portions.

18. The device of claim 16 wherein the interior member has a first dimension in a first direction that is smaller than a second dimension in the first direction between the flange portions of the first and second handles.

19. The device of claim 16, further comprising a ridge formed on the interior surface of the interior member to act as a bearing to reduce friction between the interior member and the support member.

* * * * *